US006186327B1

(12) United States Patent
Hadden

(10) Patent No.: US 6,186,327 B1
(45) Date of Patent: Feb. 13, 2001

(54) CARPET SAMPLE BOOK

(75) Inventor: James W. Hadden, LaGrange, GA (US)

(73) Assignee: Interface, Inc., Atlanta, GA (US)

( * ) Notice: Under 35 U.S.C. 154(b), the term of this patent shall be extended for 0 days.

(21) Appl. No.: 09/308,987

(22) PCT Filed: Jan. 12, 1998

(86) PCT No.: PCT/US98/00369

§ 371 Date: May 25, 1999

§ 102(e) Date: May 25, 1999

(87) PCT Pub. No.: WO98/30470

PCT Pub. Date: Jul. 16, 1998

Related U.S. Application Data

(60) Provisional application No. 60/035,048, filed on Jan. 13, 1997, and provisional application No. 60/050,000, filed on Jun. 5, 1997.

(51) Int. Cl.[7] ..... B65D 73/00

(52) U.S. Cl. ..... 206/472; 206/450; 206/486; 206/733; 206/775; 206/784; 190/16

(58) Field of Search ..... 206/450, 472, 206/486, 733, 775, 784, 747, 748; 190/16; 211/45

(56) References Cited

U.S. PATENT DOCUMENTS

| | | | |
|---|---|---|---|
| D. 160,830 | 11/1950 | Aron . | |
| 244,818 | 7/1881 | McLean . | |
| 958,218 | 5/1910 | Benze . | |
| 1,564,152 | 12/1925 | Thomson | 206/472 |
| 1,906,555 | 5/1933 | Donnell | 206/472 X |
| 1,977,667 | 6/1934 | Breitkreuz . | |
| 2,126,407 | 8/1938 | Payne et al. . | |
| 2,239,145 | 4/1941 | Doner | 206/450 X |
| 2,833,457 | 5/1958 | Tyrseck . | |
| 3,138,261 | 6/1964 | Witteborg . | |
| 3,185,308 | 5/1965 | Howard . | |
| 3,352,415 | 11/1967 | Seeley et al. | 206/472 X |
| 3,514,875 | 6/1970 | Howard . | |
| 3,532,412 | 10/1970 | Miller | 206/456 X |
| 3,620,552 | 11/1971 | Woodcock et al. . | |
| 3,816,948 | 6/1974 | Mooney et al. . | |
| 3,841,548 | 10/1974 | Curley . | |
| 4,063,648 | 12/1977 | Fuller et al. . | |
| 4,240,761 | 12/1980 | Jacobson . | |
| 4,651,872 | 3/1987 | Joyce . | |
| 4,703,943 | 11/1987 | Zelenko et al. . | |
| 4,880,327 | 11/1989 | Sanabria . | |
| 5,259,517 | 11/1993 | Pancoe . | |
| 5,316,138 | 5/1994 | Thompson . | |
| 5,407,076 | 4/1995 | Sabet . | |
| 5,611,433 | 3/1997 | Levy | 206/569 |
| 5,931,301 | 8/1999 | Hadden et al. . | |

*Primary Examiner*—Bryon P. Gehman
(74) *Attorney, Agent, or Firm*—John S. Pratt; Kristin L. Johnson; Kilpatrick Stockton LLP

(57) ABSTRACT

A carpet sample book is constructed from a single sheet of cardboard or other suitable material. The sheet is creased to define a number of panels. The sheet may be folded over itself to make the panels several layers thick. Cutouts are made through some or all of the layers to holding carpet samples. The creases act like hinges which allow the panels to be folded over each other so that the entire assembly can be folded into a compact book.

7 Claims, 7 Drawing Sheets

CARPET SAMPLE BOOK

RELATED APPLICATIONS

This application claims priority to U.S. patent applications Ser. No. 60/035,048 filed Jan. 13, 1997, entitled "Carpet Sample Book," and Ser. No. 60/050,000 filed Jun. 5, 1997, entitled "Carpet Sample Book," which are incorporated by reference herein.

BACKGROUND OF THE INVENTION

A wide variety of carpet styles are readily available for installation in home and office settings. In order to show prospective buyers these styles, a carpet salesman must carry a large number of carpet swatches to meetings with buyers. Typically, these carpet swatches are held together in a "flip-book," i.e., a number of small squares or rectangles of carpet bound together at one end, allowing the buyer to flip through the various different styles. Flip-books are bulky and not particularly stable, making the flip-book difficult to use and even more difficult to carry from meeting to meeting.

Carpet sample books have been disclosed which address the problems associated with carrying about carpet samples. For instance, U.S. Pat. No. 5,316,138 to Thompson, entitled "Carpet Display Sample Kit," discloses a sample kit comprising a box and a support tray. While Thompson's kit makes it easier to carry a number of carpet samples about, it accommodates only a limited number of samples. Moreover, Thompson's kit is relatively complex and requires several parts. This may increase the weight of the kit, making it bulky and difficult to carry. Also, the multi-part construction may increase the cost and complexity of manufacture.

Thus, it is desirable to provide a carpet sample book which is lightweight, easy to manufacture and capable of carrying and displaying a large number of carpet samples.

SUMMARY OF THE INVENTION

A carpet sample book in accordance with the present invention is constructed from a single sheet of cardboard or other suitable material. The sheet is creased to define a number of panels. The sheet may be folded over itself to make the panels several layers thick. Cutouts are made through some or all of the layers to holding carpet samples. The creases act like hinges which allow the panels to be folded over each other so that the entire assembly can be folded into a compact book.

The sample book of the present invention provides several advantages over prior sample books. Because the sample book may be constructed from a single sheet of material, its fabrication is relatively simple and therefore inexpensive. Moreover, the sample book is very light and compact, thereby reducing the difficulty in transporting numerous carpet samples about. Also, because of the simple design, it is easy to customize the sample book for individual needs, thereby providing a wide range of options to users without substantially increasing production cost or complexity.

Accordingly, it is an object of the invention to provide a carpet sample book that allows numerous samples to be displayed.

Another object of the invention is to provide a carpet sample book that allows numerous samples to be displayed in a book which may be folded into a relatively compact configuration.

Another object of the invention to provide a carpet sample book that allows samples to be easily removed from the sample book for closer inspection.

Another object of the invention to provide a carpet sample book which may be constructed from a single sheet of material.

Other objects, features and advantages of the present invention will become apparent with reference to the drawings, the following description of the drawings and the claims.

DETAILED DESCRIPTION OF THE DRAWINGS

The carpet sample book of the present invention organizes a large number of carpet samples in an attractive and compact package. FIGS. 1–10 show a first illustrative embodiment of a sample book 10 in accordance with the present invention. Book 10 may be constructed from a single sheet of suitable material, including, but not limited to, cardboard, fiberboard, corrugated pasteboard, corrugated plastic board or any other suitable material. The sheet is folded and affixed in the desired shape, as discussed in detail below.

Figure 1:
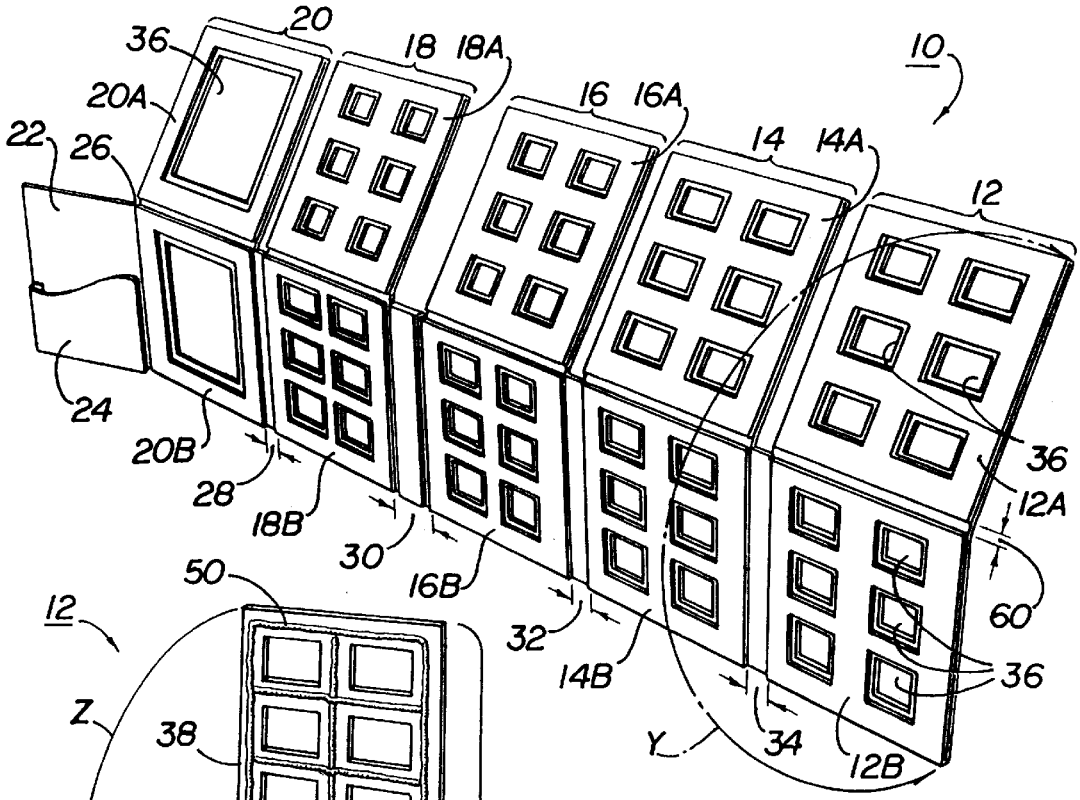
FIG. 1 perspective view of a first embodiment of a carpet sample book in accordance with the present invention.

FIG. 1 shows sample book 10 in its fully unfolded configuration. Book 10 has five panel sections 12–20, each divided into two portions 12A, 12B; 14A, 14B; etc. A pocket panel 22 may also be provided. Pocket panel 22 includes pocket 24 into which printed materials, such as brochures and other promotional materials may be inserted. Intermediate panels 26–34 are provided between panels 12–22 to allow sample book 10 to be folded.

Each panel portion 12A/B–20A/B includes at least one sample window 36, and may have six or more windows 36 in each portion 12A/B–20A/B. Furthermore, the number and size of windows 36 in each portion 12A/B–20A/B may be varied for aesthetic or other reasons. Likewise, the number of panels 12–22 may be varied as desired.

Each panel portion 12A/B–20A/B, regardless of the number of windows 36, is constructed in essentially the same fashion. Thus, the following discussion will be restricted to panel 12, but it should be understood to apply to any of the panels 12–20 of sample book 10.

Figure 2:
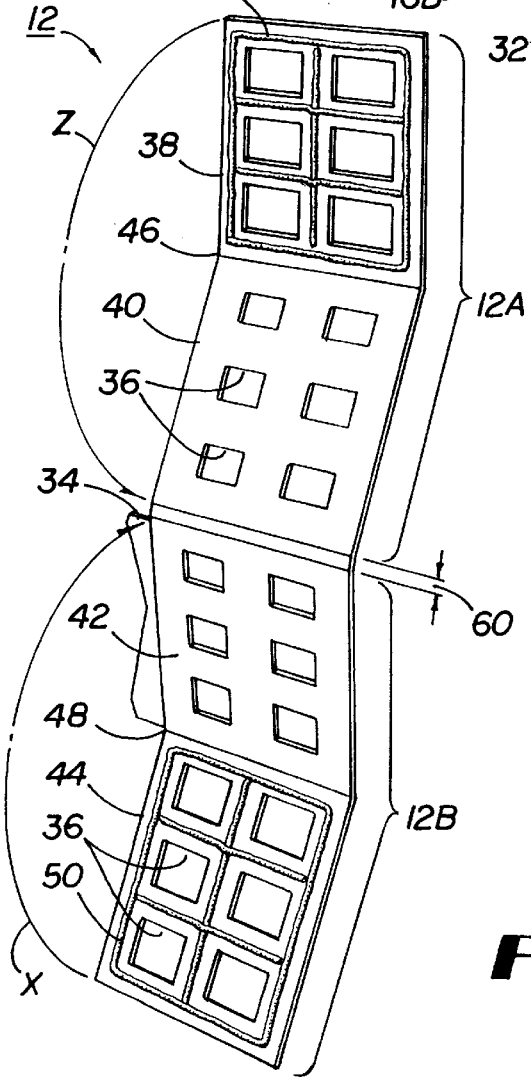
FIG. 2 is a partial perspective view of the sample book of FIG. 1 in a disassembled state.

As illustrated in FIG. 2, panel 12 is constructed from a single sheet of material which may be cardboard, pasteboard or any other suitable material. Panel 12 is divided into four sub-panels 38–44. Sub-panels 38–44 are folded along crease lines 46 and 48 to form portions 12A and 12B. For example, sub-panel 38 is folded down in the direction of arrow Z about crease line 46 so that it matches up with sub-panel 40. Similarly, sub-panel 44 is folded up in the direction of arrow X about crease line 48 so that it matches up with sub-panel 42. Windows 36 are precut into each sub-panel 38–44 so that when the sub-panels are matched, windows 36 also line up. Adhesive 50 may be applied on sub-panels 38–44 between windows 36 for the purpose of affixing the complimentary sub-panels to each other. Other bonding methods may be used, either permanent or temporary, as may be appropriate. Intermediate panels 26–34 may also be constructed in a multi-layer manner as appropriate.

Figure 3:
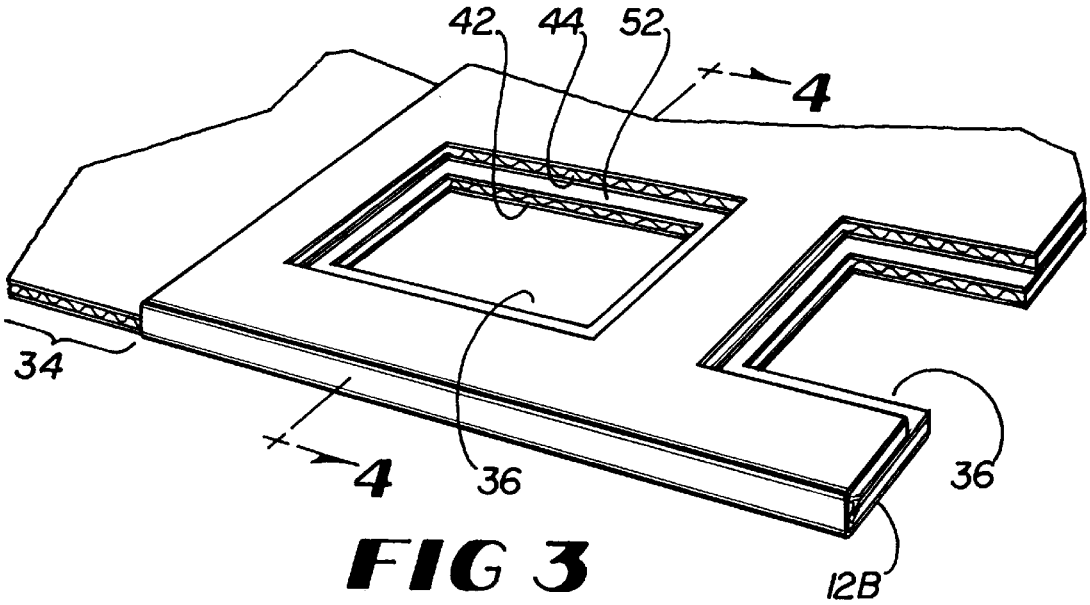
FIG. 3 is a partial perspective view of the sample book of FIG. 1.
Figure 4:
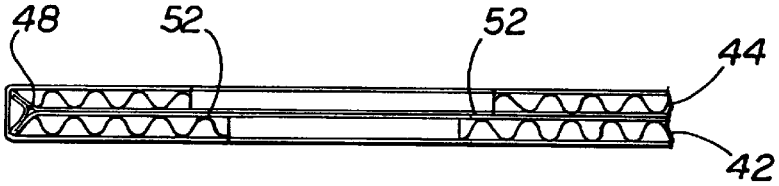
FIG. 4 is a partial cross-sectional view of the sample book of FIG. 1.
Figure 4A:
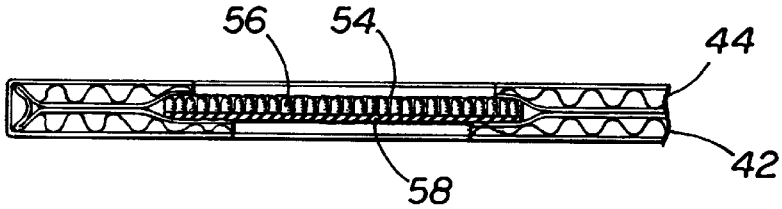
FIG. 4A is a partial cross-sectional view of the sample book of FIG. 1 similar to FIG. 4, with a carpet sample installed therein.
Figure 4B:
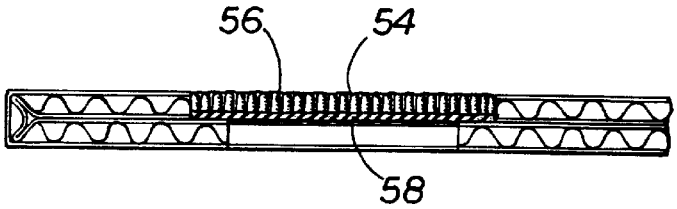
FIG. 4B is a partial cross-sectional view of the sample book of FIG. 1 similar to FIG. 4, with a carpet sample of a different size than in FIG. 4A installed therein.

FIG. 3 illustrates a perspective view of a window 36 of portion 12B. Window 36 in sub-panel 44 is slightly larger than window 36 in sub-panel 42, thus creating ledge 52. As shown in FIGS. 4 and 4A–B, when sub-panels 42 and 44 are folded over crease line 48, windows 36 in each sub-panel match up, forming ledge 52. As shown in FIG. 4A, carpet sample 54 may be inserted between sub-panels 42 and 44 to be secured within windows 36 in such a manner as to allow both pile surface 56 and backing surface 58 to be visible. Thus, sample 54 may be affixed in place by frictional force. Alternatively, as shown in FIG. 4B, sample 54 may be glued to ledge 52, thus allowing sample book 10 to be prefabricated and samples 54 installed at a later date. Also, window 36 may sized such that sample 54 will fit snugly therein, thereby obviating the need for glue.

Figure 5:
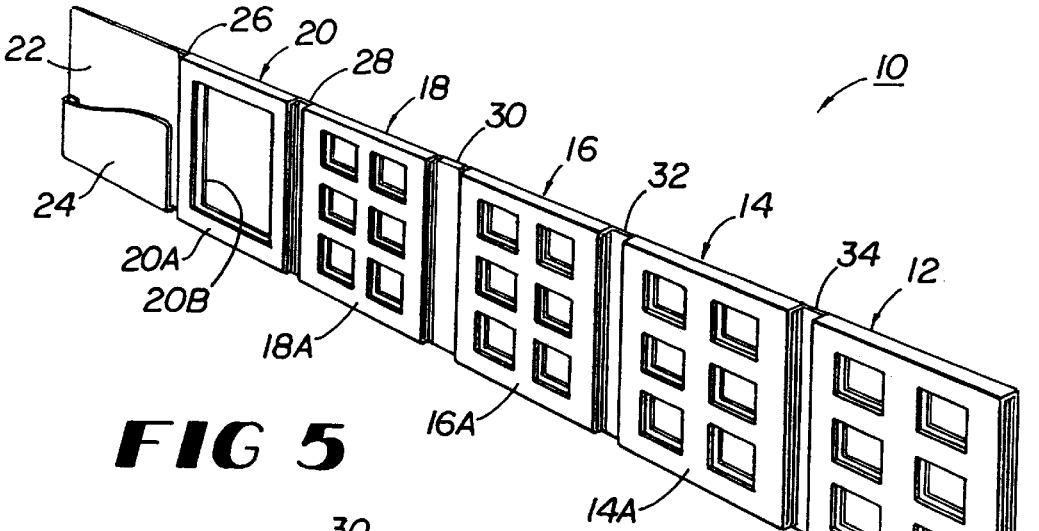
FIG. 5 is a perspective view of the sample book of FIG. 1 in a partially folded state.

As shown in FIG. 1, crease segment 60 is provided between portions A and B of panels 12–20. Crease segment 60 allows portions A of panels 12–20 to be folded down in the direction of arrow Y. FIG. 5 shows sample book 10 with portions A of panels 12–20 folded down.

Figure 6:
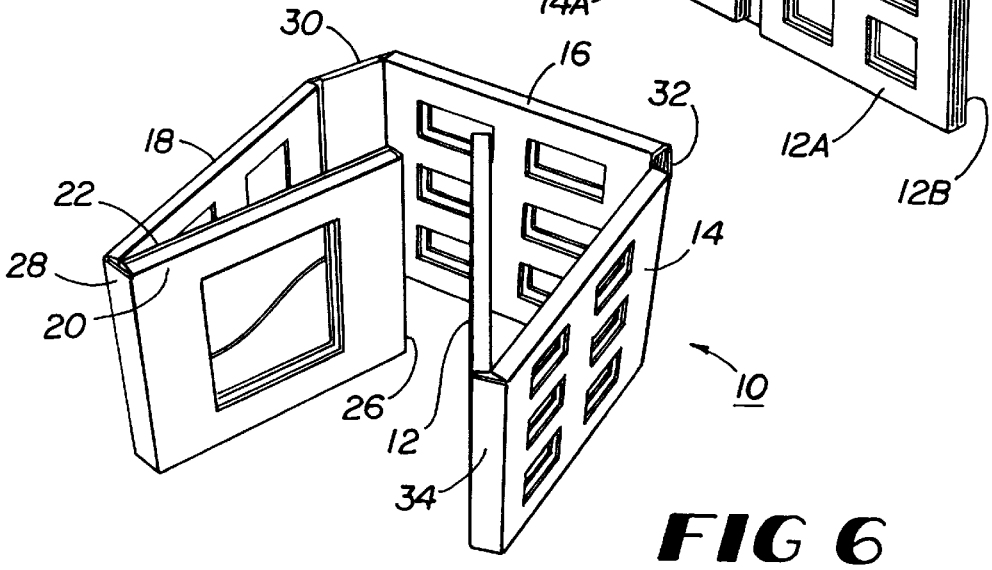
FIG. 6 is a perspective view of the sample book of FIG. 1 in a partially folded state.
Figure 7:
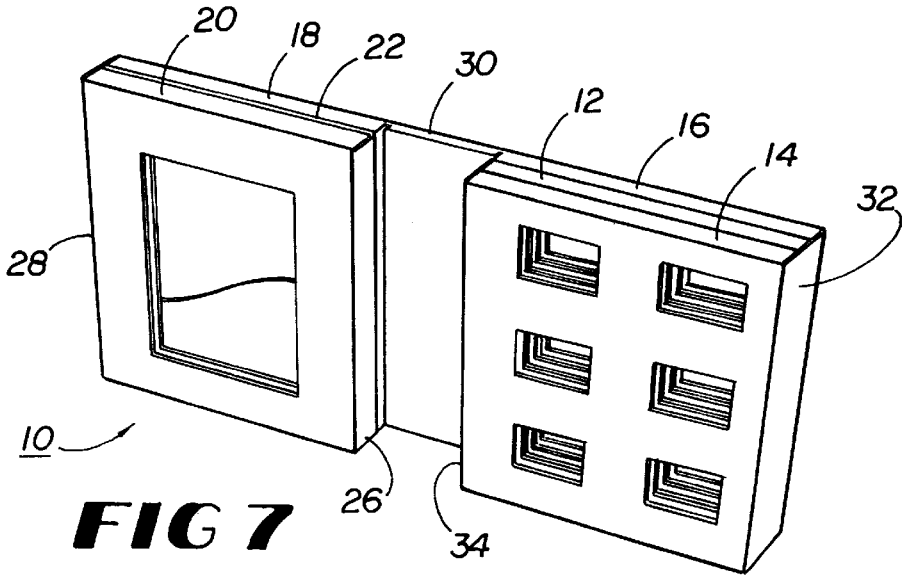
FIG. 7 is a perspective view of the sample book of FIG. 1 in a partially folded state.
Figure 8:
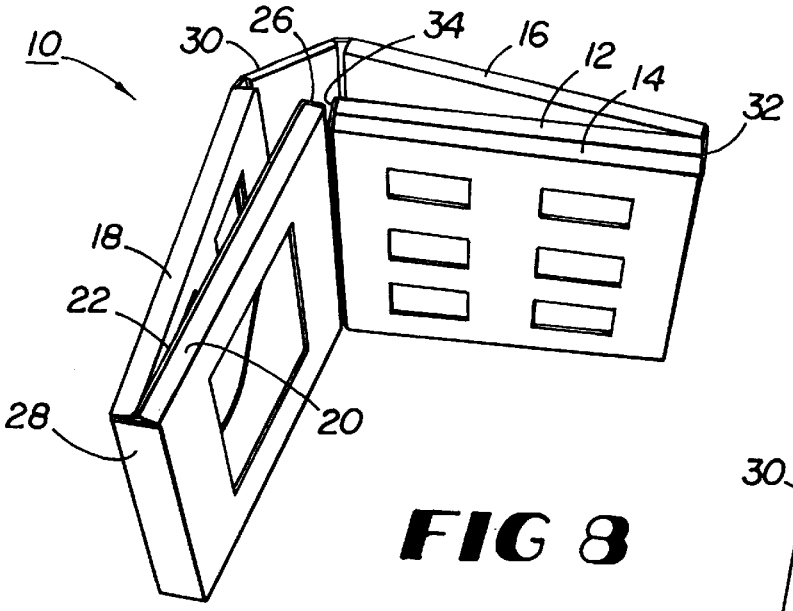
FIG. 8 is a perspective view of the sample book of FIG. 1 in a partially folded state.
Figure 9:
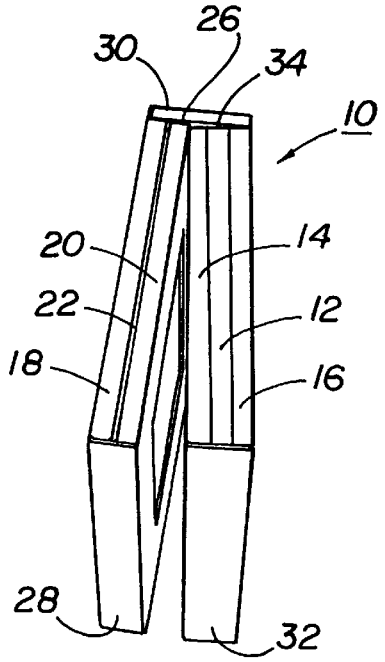
FIG. 9 is a perspective view of the sample book of FIG. 1 in a partially folded state.
Figure 10:
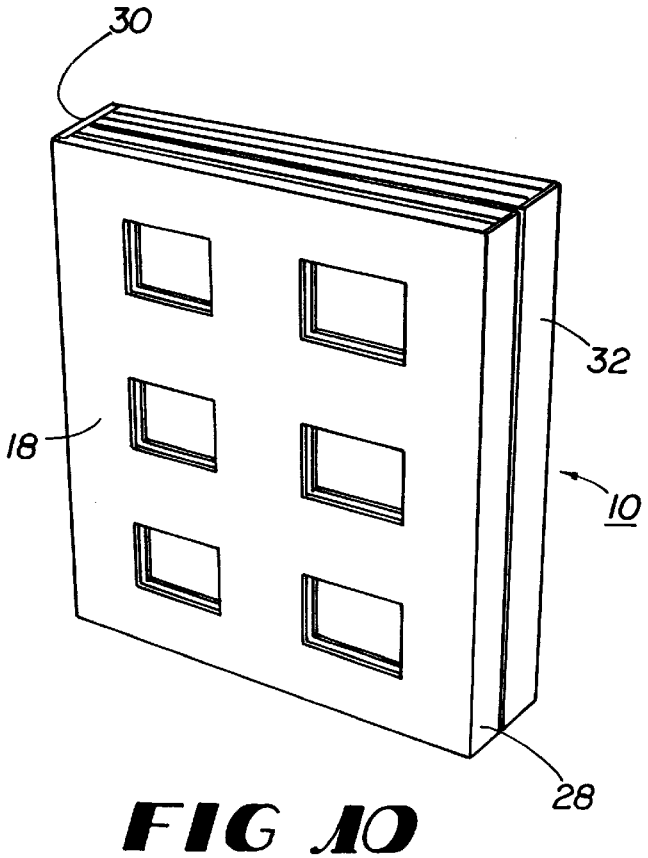
FIG. 10 is a perspective view of the sample book of FIG. 1 in a fully folded state.
Figure 11A:
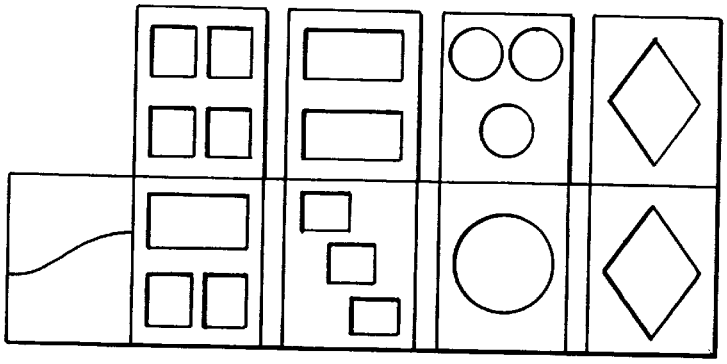
FIG. 11A is a plan view of a second embodiment of the carpet sample book of the present invention.
Figure 11B:
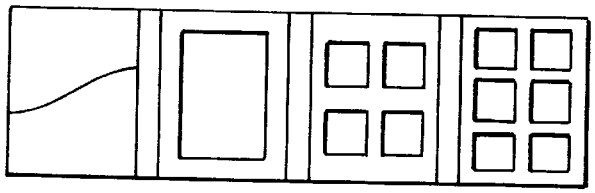
FIG. 11B is a plan view of a third embodiment of the carpet sample book of the present invention.
Figure 11C:
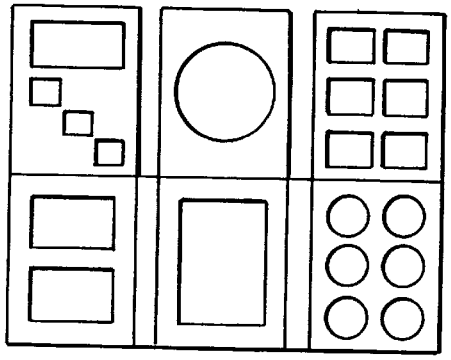
FIG. 11C is a plan view of a fourth embodiment of the carpet sample book of the present invention.
Figure 11D:
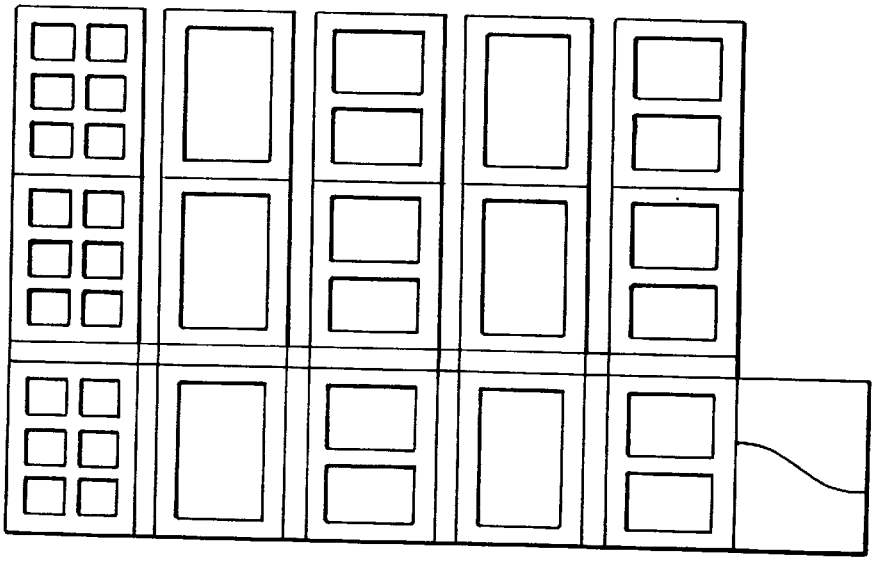
FIG. 11D is a plan view of a fifth embodiment of the carpet sample book of the present invention.

As shown in FIG. 6, by folding panels 12–20 about intermediate panels 26–34, sample book 10 may be further collapsed. FIGS. 7 and 8 show sample book 10 in an almost completely collapsed configuration. FIGS. 9 and 10 show sample book 10 in its completely folded configuration (note that in FIG. 9, sample book 10 is slightly open to more clearly show detail.) Note that intermediate panels 26–34 act like hinges and may be varied in size to accommodate the thickness of panels 12–24.

By providing carpet samples 54 of different colors or carpet styles, it is possible to present a highly attractive collection of different carpet samples, together with printed materials, utilizing the sample book 10 of the present invention. In the first illustrative embodiment, for instance, fifty carpet sample may be exhibited in sample book 10. Nonetheless, sample book 10 maybe collapsed into a relatively compact package for transportation and storage. For instance, the illustrative embodiment shown in FIGS. 1–10 has unfolded dimensions of five and one half feet by two feet by one quarter of an inch. When collapsed, however, the dimensions are eleven and one half inches by ten and one half inches by three inches. Thus, when collapsed, the sample book is easily transported in a salesman's briefcase or through the postal system.

Of course, alternative configurations may present more or less samples by varying the number of windows 36 in each panel, or by varying the number of panels or panel portions, as desired, as shown in FIGS. 11A–D. Likewise, the shape and layout of the windows may be altered for aesthetic or other reasons. As will be readily apparent to those skilled in the art, sample book 10 may be fabricated of pasteboard or a variety of alternative sheet materials that have appropriate characteristics permitting them to be cut, scored, bent, folded and printed on as is desirable in fabricating the sample book 10.

FIGS. 12–18 illustrate an alternative embodiment of a sample book in accordance with the present invention. Book 100 may be constructed from a single sheet of suitable material, including, but not limited to, cardboard, fiberboard, corrugated pasteboard, corrugated plastic board or any other suitable material. The sheet is folded and affixed in the desired shape, as discussed in detail below.

Figure 12:
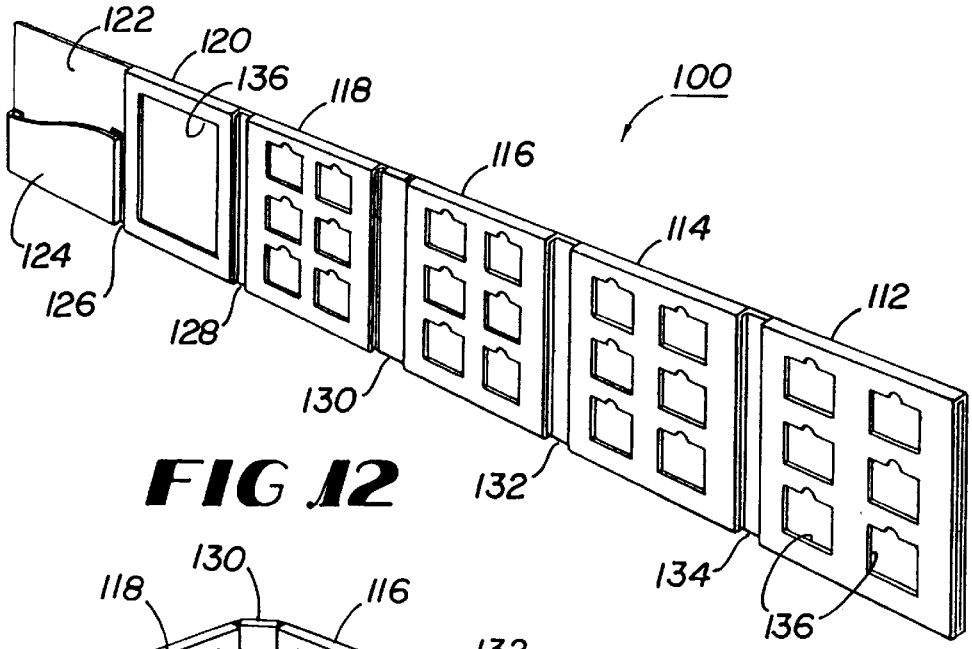
FIG. 12 is a perspective view of a sixth embodiment of the carpet sample book of the present invention in a disassembled state.

FIG. 12 shows sample book 100 in its fully unfolded configuration. Book 100 has five panel sections 112–120. A pocket panel 122 may also be provided. Pocket panel 122 includes pocket 124 into which printed materials, such as brochures and other promotional materials may be inserted. Intermediate panels 126–134 are provided between panels 112–122 to allow sample book 100 to be folded.

Each panel 112–120 includes at least one sample window 136, and may have six or more windows 136 in each portion 112–120. Furthermore, the number and size of windows 136 in each portion 112–120 may be varied for aesthetic or other reasons, in manner similar to that shown in FIGS. 11A–11D. Likewise, the number of panels 112–122 may be varied as desired.

Figure 13:
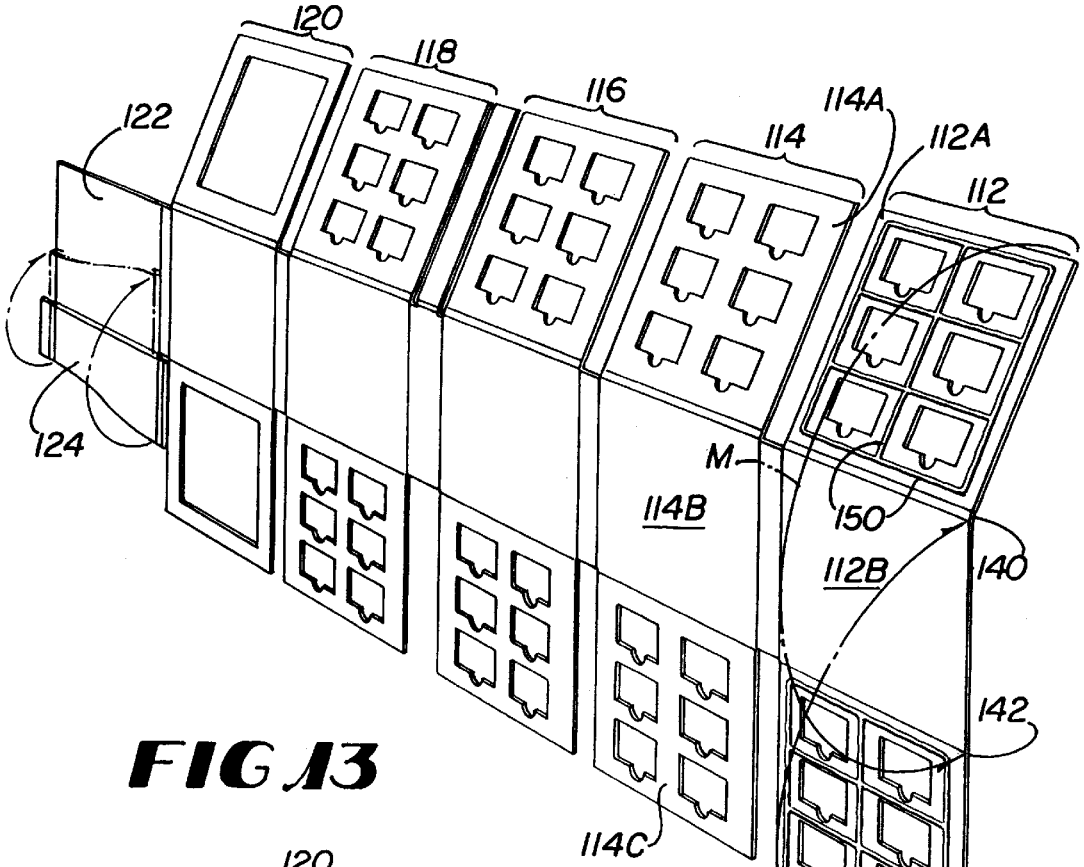
FIG. 13 is a perspective view of a sample book of FIG. 12 in a partially disassembled state.
Figure 14:
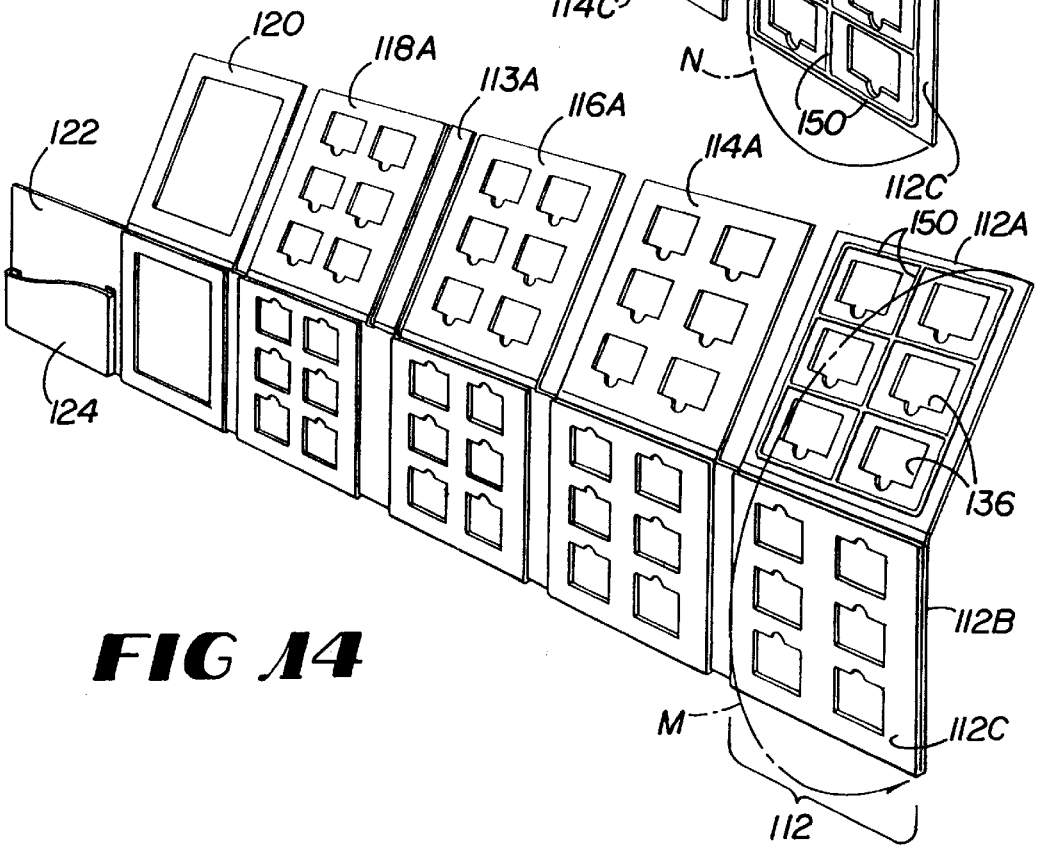
FIG. 14 is a perspective view of a sample book of FIG. 12 fully assembled.

As illustrated in FIG. 13, book 100 is constructed from a single sheet of material which may be cardboard, pasteboard or any other suitable material. Each panel 112–120 is divided into three sub-panels 112A, 112B, 112C; 114A, 114B, 114C; etc. Sub-panels A and C of each panel 112–120 are folded along crease lines 140 and 142 in directions M and N, respectively, to form panels 112–120. For example, sub-panel 112C is folded up in the direction of arrow N about crease line 142 so that it lays against sub-panel 112B. Similarly, sub-panel 112A is folded down in the direction of arrow M about crease line 140 so that it matches up with sub-panel 112C. Windows 136 are precut into each sub-panel 112A and 112C so that when the sub-panels are matched, windows 136 also line up. Adhesive 150 may be applied on the sub-panels A and C of panels 112–120 between windows 136 for the purpose of affixing the complimentary sub-panels to each other. Other bonding methods may be used, either permanent or temporary, as maybe appropriate. Intermediate panels 126–134 may also be constructed in a multi-layer manner as appropriate.

Figure 15:
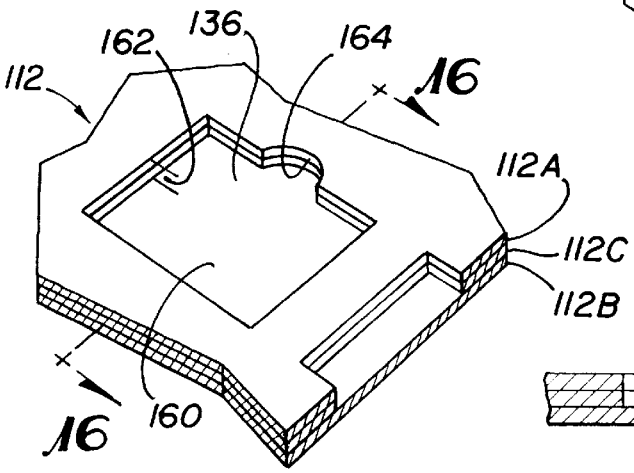
FIG. 15 is a perspective view of a sample book of FIG. 12 partially folded.
Figure 16:
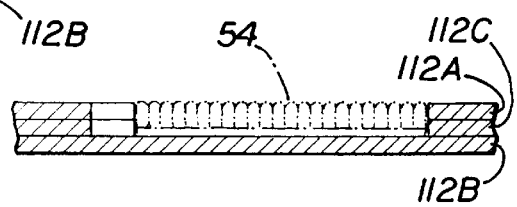
FIG. 16 is a perspective view of a sample book of FIG. 12 fully folded.

As shown in FIGS. 15 and 16, windows 136 have a backing 160 made up of sub-panel B and walls 162 made up of sub-panels A and C. A finger-hole 164 may be provided to allow easy installation and removal of carpet sample 54. Carpet sample 54 may be inserted into window 136 and held in place by frictional force, of, if desired, an adhesive.

Figure 17:
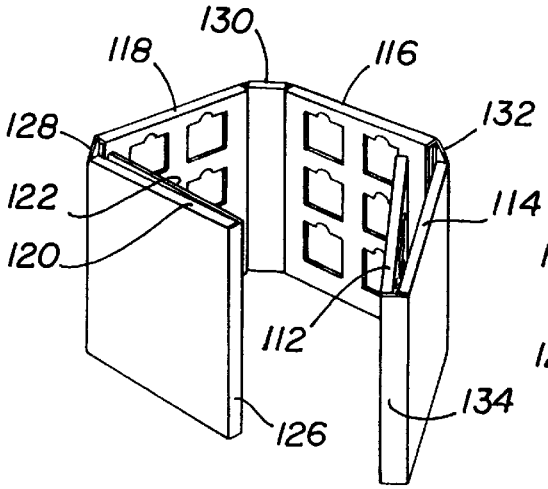
FIG. 17 is a partial perspective view of a sample book of FIG. 12.
Figure 18:
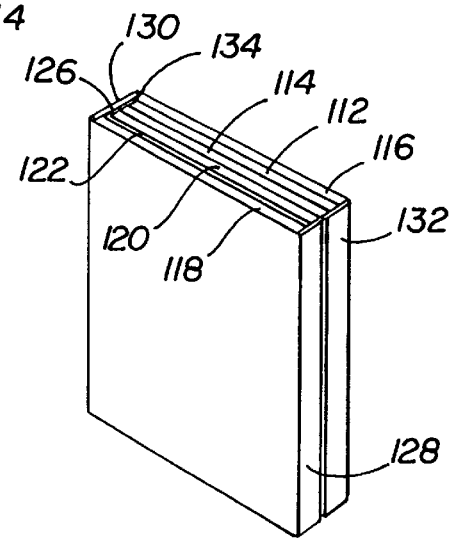
FIG. 18 is a partial cross-sectional view of a sample book of FIG. 12.

As shown in FIGS. 17 and 18, book 110 folds up in a manner similar to book 10, described above. This allows book 110 to be stored or transported in a compact form. Both books 10 and 110 may be held closed by means of a hook and loop fastener affixed to panels 28/32 and 128/132 respectively (not shown). Other conventional fasteners may be used. Similarly, the features of any of the embodiments illustrated in FIGS. 1–18 may be combined as desired to provide other alternative embodiments.

Although the foregoing is provided for purposes of illustrating, explaining and describing certain embodiments of the modular divider screen in particular detail, modifications and adaptations to the described screens and other embodiments will be apparent to those skilled in the art and may be made without departing from the scope or spirit of the invention.

What is claimed is:

1. A sample book comprising:

a) a first page constructed from a single sheet of material and comprising a top edge, a side edge, and a display surface defining at least one sample window;

b) a second page constructed from the single sheet of material and comprising a side edge affixed to the side edge of the first page and a display surface defining at least one sample window; and c) a third page constructed from the single sheet of material and having a bottom edge affixed to the top edge of the first page and a display surface defining at least one sample window.

2. The sample book of claim 1 in which the first page further comprises first and second panels wherein the second panel abuts the first panel and each panel defines at least on window wherein the at least one window of the first and second panels are aligned to define the at least one sample window.

3. The sample book of claim 2 in which the third page further comprises third and fourth panels wherein the fourth panel abuts the third panel and the third and fourth panels each define at least one window wherein the at least one window of the third and fourth panels are aligned to define the at least one sample window.

4. A sample book comprising at least one page constructed from a single sheet of material and comprising:

a) a top edge, a side edge and a display surface defining at least one sample window; and b) first, second and third panels wherein the third panel abuts the second panel and the first panel abuts the third panel and the first and third panels each define at least one window positioned such that the at least one window of the first and third panels are aligned to define the at least one sample window.

5. A sample book for displaying carpet samples comprising a sheet defining a plurality of central panels, corresponding lower panels in which the lower panels are folded to abut the central panels, and a plurality of upper panels corresponding to the central panels and a plurality of extended upper panels corresponding to the upper panels in which the extended upper panels are folded to abut the upper panels, the central panels each define at least one ledged window.

6. The sample book of claim 5 in which the central panels each define at least one ledged window which corresponds to and aligns with a ledged window defined in the corresponding lower panels.

7. The sample book of claim 6 in which the upper panels each define at least one ledged window which corresponds to and aligns with a ledged window defined in the corresponding extended upper panels.

* * * * *

UNITED STATES PATENT AND TRADEMARK OFFICE

CERTIFICATE OF CORRECTION

PATENT NO. : 6,186,327 B1
DATED : February 13, 2001
INVENTOR(S) : James W. Hadden It is certified that error appears in the above-identified patent and that said Letters Patent is hereby corrected as shown below:

Column 6,
Line 5, delete "on" and insert -- one --
Line 15, add a space between "A" and "sample book"

Signed and Sealed this

Fifteenth Day of January, 2002

*Attest:*

*Attesting Officer*

JAMES E. ROGAN
*Director of the United States Patent and Trademark Office*